United States Patent [19]

Goller

[11] Patent Number: 5,072,530

[45] Date of Patent: Dec. 17, 1991

[54] DEVICE FOR PREPARING THE LANDING PISTE OF A SKI-JUMP

[75] Inventor: Walter Goller, Ortisei, Italy

[73] Assignee: Prinoth S.p.A., Ortisei, Italy

[21] Appl. No.: 495,851

[22] Filed: Mar. 19, 1990

[30] Foreign Application Priority Data

Oct. 17, 1989 [IT] Italy ..... 22047 A/89

[51] Int. Cl.[5] ..... E01H 4/00

[52] U.S. Cl. ..... 37/219; 37/266; 37/268

[58] Field of Search ..... 37/219, 221, 220, 266, 37/268, 270, 115

[56] References Cited

U.S. PATENT DOCUMENTS

| | | | |
|---|---|---|---|
| 1,919,228 | 7/1933 | Lang | 37/115 |
| 3,692,119 | 9/1972 | Tucker | 37/219 |
| 3,926,262 | 12/1975 | Brooks | 37/219 |
| 4,560,303 | 12/1985 | Haug et al. | 37/219 X |
| 4,651,451 | 3/1987 | Beeley et al. | 37/219 |

*Primary Examiner*—Dennis L. Taylor
*Assistant Examiner*—J. Russell McBee
*Attorney, Agent, or Firm*—Ladas & Parry

[57] ABSTRACT

Device for preparing the landing plate of a ski-jump, guide and deflection rollers being arranged, provided with clearance, in the vicinity of the take-off platform of the ski-jump, which rollers receive a cable, the ends of which, arranged along the landing plate, can be connected to two snow vehicles.

10 Claims, 3 Drawing Sheets

DEVICE FOR PREPARING THE LANDING PISTE OF A SKI-JUMP

FIELD OF THE INVENTION

The invention specified above relates to a device for preparing the landing piste of a ski-jump.

BACKGROUND OF THE INVENTION

Ski-jump sites are known to end in a landing piste which has a certain cross-sectional profile and enables the athlete to land again after the flight. Those skilled in the art know that the landing piste has a very steeply designed central part in order to reduce the impact during the landing process to a minimum.

The landing piste must have a satisfactory covering of snow, particularly in the case of sporting competitions. For this reason, teams of workers are still employed even today to prepare the landing piste as best they can using manual equipment, such as spades and rakes. Considering the fact that numerous athletes participate in a sporting competition and carry out several jumps, it is easily understandable that the landing piste is subjected to considerable wear during the competition, wear that, even today, can only be remedied temporarily during the intervals in the competition; this is due to the considerable size of the landing piste of a ski-jump and the equipment used hitherto.

SUMMARY OF THE INVENTION

The object of the invention stated above is to propose means, with which it is possible to prepare the landing piste of a ski-jump using motorized equipment and to enable the covering of snow of the landing piste to be repaired in the shortest time, even during the intervals in the competition.

According to the invention, this object is achieved by the fact that guide and deflection rollers are provided which are arranged with clearance in the vicinity of the take-off platform of the ski-jump and receive a cable, the ends of which are arranged along the landing piste and these ends can be connected to two snow vehicles.

In order to avoid the landing piste of the ski-jump being damaged by the loaded cable parts, the cable is equipped with float-type support bodies or gliders which are freely movable on the landing piste.

Further advantages of the invention can be taken from the following description, the claims and the drawings.

BRIEF DESCRIPTION OF THE DRAWINGS

The subject of the invention is now described in more detail with reference to an exemplary embodiment and illustrated in the drawings, in which.

DETAILED DESCRIPTION OF THE PREFERRED EMBODIMENT

Figure 1:
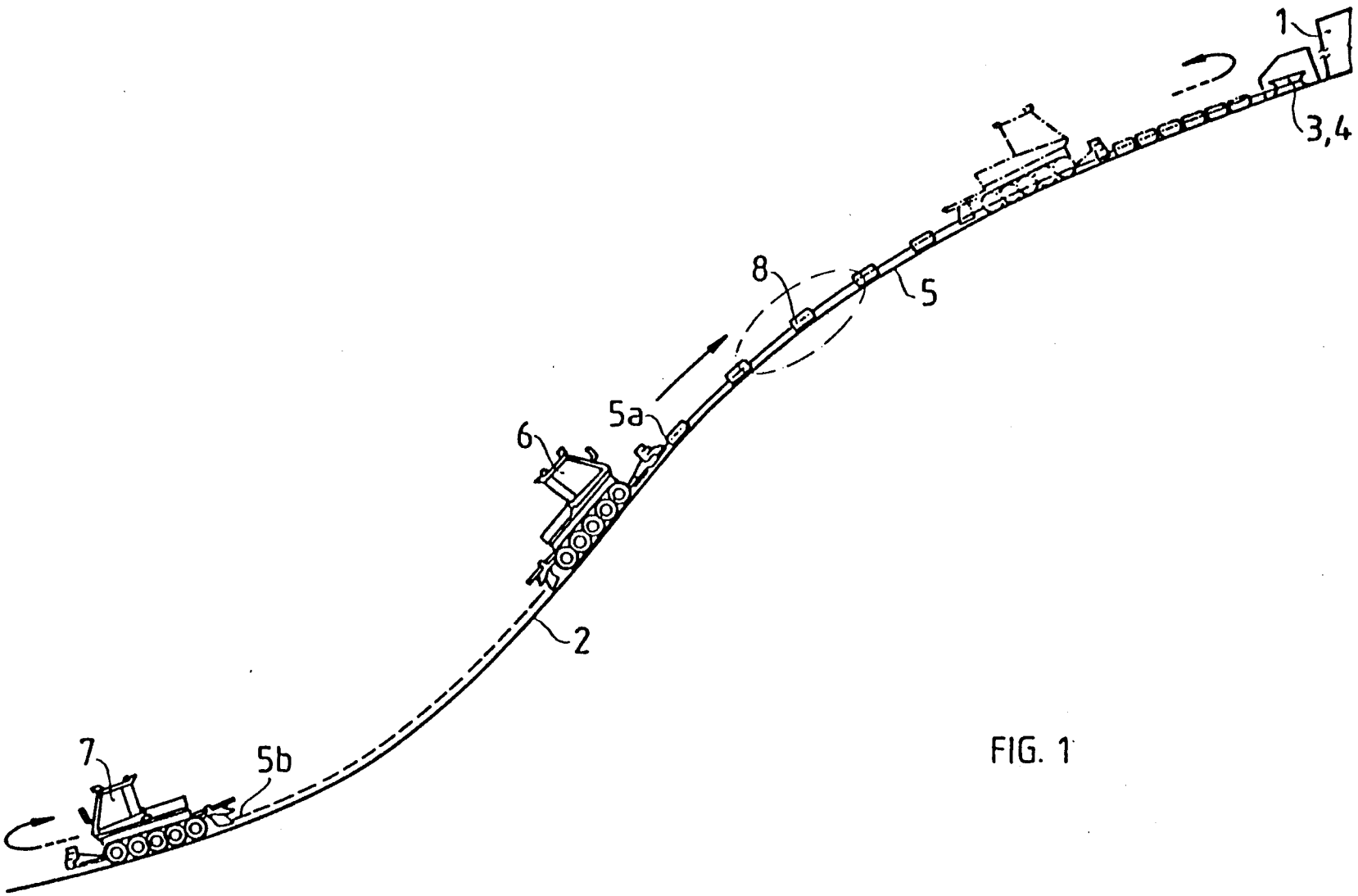
FIG. 1 shows a lateral view of the landing piste of a ski-jump having the devices according to the invention.

As can be seen in FIG. 1, a landing piste 2 is provided after the take-off platform of a ski-jump 1, the landing piste having a profile which consists partially of very steep sections. These sections cannot easily be driven over by a snow vehicle.

The landing piste 2 is frequently also covered with a thin layer of plastic in order to enable the ski-jump competition to be carried out even in the case of an insufficient covering of snow.

According to the invention, guide and deflection rollers 3 and 4, which are arranged with clearance, are provided in the immediate vicinity of the ski-jump platform 1. These rollers 3, 4 serve as a guidance for a cable 5, the ends 5*a*, 5*b* of which rest on the landing piste.

Two snow vehicles 6 and 7 can be connected to the ends 5*a* and 5*b* of the cable 5.

The cable parts 5*a* and 5*b* are also fitted with float-type gliding bodies which, in total, are denoted as 8 and which will be described subsequently in more detail.

Figure 2:
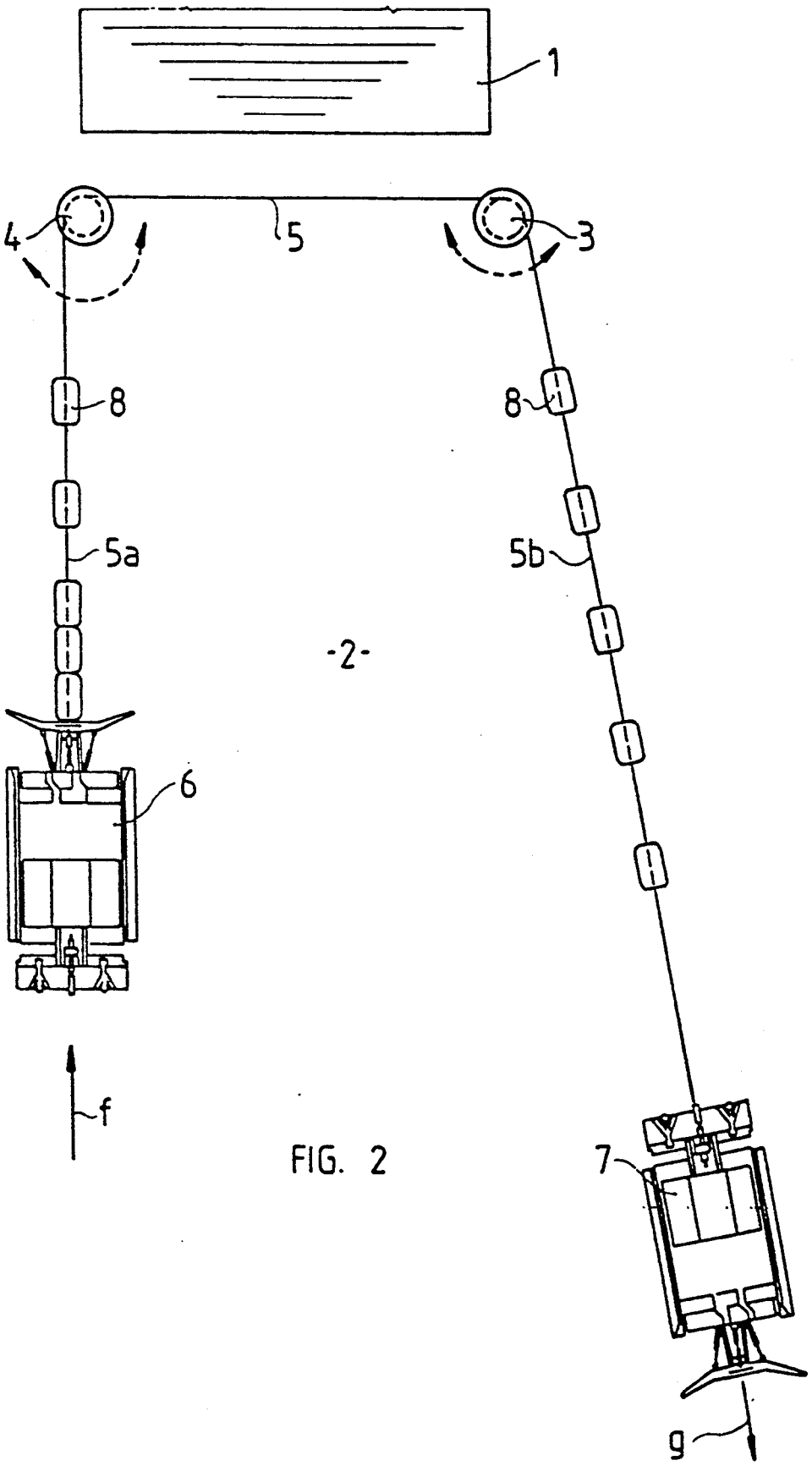
FIG. 2 shows a plan view of the landing piste of the ski-jump having the means according to the invention and FIG. 3 shows a detailed and perspective view of the floats or gliding bodies connected to the cable.

It can be seen in FIG. 2 that the guide and deflection rollers 3 and 4 are arranged in the immediate vicinity of the ski-jump platform 1. As can also be seen in FIG. 2, the rollers 3 and 4 are arranged on the right and left sides of the ski-jump platform 1. The cable 5 guided and held by the rollers 3 and 4 forms two cable parts 5*a* and 5*b* arranged along the landing piste, to the ends of which snow vehicles 6 and 7 can be connected. Each snow vehicle is equipped in a known manner with a front shield and a plough shaft arranged at the rear. In an advantageous manner, the drive crawlers of each vehicle 6, 7 are of particularly soft design in order to avoid damaging the underground part of the landing piste 2 of the ski-jump. Crawlers of this type have, for example, a V-shaped profile and have been used by the applicant for many years. These crawlers have proved to be particularly advantageous for light-weight vehicles which have to operate on particularly sensitive ground.

Each cable part 5*a*, 5*b* is equipped with a number of float-type gliding bodies. The task of the bodies 8 is to glide over the ground of the landing piste 2 and they should prevent the underground part of the landing piste 2 from being damaged by the cable parts 5*a* and 5*b* which are considerably loaded by the snow vehicle 6, 7.

It can also be seen in FIG. 2 that the float-type bodies 8 are arranged movably on the cable parts 5*a* and 5*b* as will be described in more detail. The movable arrangement of the float bodies 8 allows automatic setting of the distance between the float-type bodies 8 as soon as a snow vehicle (e.g. the vehicle 7) approaches the end of the landing piste 2 (valley side). When the snow vehicle 6 drives up to the ski-jump platform 1 (hill side), the float bodies 8 are able to remove the free spaces formed between the bodies 8 in such a way that the float bodies 8 contact one another. For this purpose, the gliding bodies 8 of float-type design consist of a body of hollow design, as can be seen in FIG. 3, which body allows free passage of the cable parts 5*a*, 5*b*.

Figure 3:
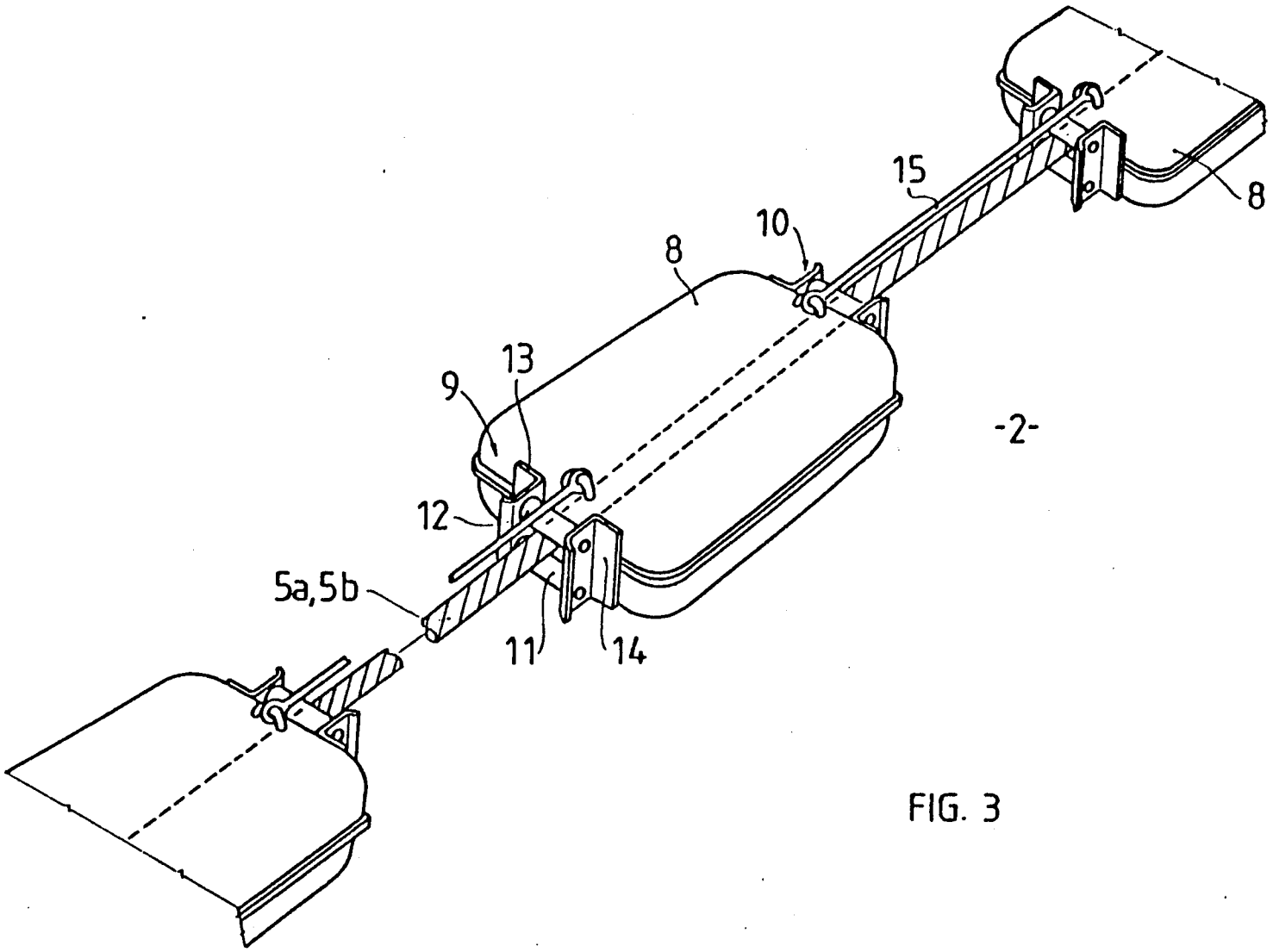

It can also be seen in FIG. 3 that the float body 8 has a rounded shape, in order to ensure good gliding properties of the body 8 on the underground part of the landing piste 2.

The entry and exit openings 9, 10 of the float-type bodies 8 are advantageously fitted with running rollers 11 and 12 which are arranged in parallel and constitute a reliable guidance for the cable parts 5*a*, 5*b*. In order to improve the guidance of the cable parts 5*a*, 5*b* further in relation to the float-type body 8, the running rollers 11 and 12 are advantageously mounted in L-shaped metal brackets 13 and 14, one arm of the L-shaped component serving for the assembly of the components 13, 14 on the float body 8 and the other arm of each L-shaped support part serving as a lateral guidance for the cable part passing through.

In order to move the float-type bodies 8 on the cable parts 5*a* and 5*b* to a desired distance automatically, the float-type bodies 8 are connected by means of an additional connecting cable 15, a chain or a similar component which serves as a spacer. This arrangement provides for the float-type body 8, which is arranged, for example, on the hill side of the cable parts 5*a* or 5*b*, to be permanently connected to the ground in the vicinity of the ski-jump platform 1.

The mode of functioning of the device according to the invention is as follows:

The snow vehicle 6 or the snow vehicle 7 is connected to the appropriate ends of the cable parts 5*a* or 5*b*, as can be seen in FIG. 2. The snow vehicle 6 is attached to the cable 5*a* by its cap piece and climbs along the landing piste 10. The vehicle 7, in contrast, is connected by its rear part to the cable part 5*b* and drives downwards over the landing piste 2.

By means of the deflection rollers 3 and 4 and the cable parts 5, 5*a*, 5*b*, the vehicles 6, 7 are completely secured in relation to the steep landing piste 2. Due to the opposite movement of the two snow vehicles (upwards movement/downwards movement), the weight of the snow vehicles is mutually compensated. This allows the landing piste 2 to be prepared using substantially lower engine forces and substantially smaller engine torque on the crawler. By this means, damage to the covering of snow and damage to the layer of plastic located below is prevented. Furthermore, by virtue of providing float-type bodies 8, damage to the finished landing piste 2 by the cable parts 5*a*, 5*b* themselves is prevented. Moreover, the float-type bodies 8 allow free movement of the snow vehicles 6, 7 towards the outer sides of the landing piste 2 as is illustrated, for example, in FIG. 2 for the snow vehicle 7.

The invention enables the landing piste 2 to be worked using the shield of the snow vehicles 2, 3 to remove excess snow. By the use of the plough unit arranged at the rear of the snow vehicle, it is possible to flatten the covering of snow or to remove any icy patches. If the snow vehicles 6, 7 are equipped additionally with a snow plough arranged at the front, it is also possible to collect snow at the side edges of the landing piste 2 and to blow it into the middle of the landing piste 2, which further improves the possibilities of piste preparation.

The speed at which the landing piste can be prepared using two snow vehicles 6, 7 and the device according to the invention is such that the landing piste 2 can be repaired even during the short intervals in the competition.

The snow vehicles 6, 7 always operate with their front end facing in the direction of travel (f) or (g). As soon as the snow vehicle 6, for example, has reached the hill-side zone of the landing piste 2 and is situated in the vicinity of the take-off platform of the ski-jump 1 and, consequently, the vehicle 7 has reached the valley-side end of the landing piste 2, the vehicles are released from the ends 5*a* and 5*b* of the cable, the vehicles are turned and the cable parts 5*a* and 5*b* are again connected to the turned snow vehicles. By this means, it is possible for the vehicle which previously drove up the hill (arrow f) now to drive with its front shield towards the valley and the vehicle 7, which in the previous work stage drove down towards the valley, now to drive up the landing piste 2 with the front shield facing towards the hill in the direction of the ski-jump platform 1.

Particularly advantageously, the cable parts 5, 5*a*, 5*b* can be wound up by means of a winch or similar device for the purposes of storage or transport.

I claim:

1. A device for preparing a landing piste of a ski-jump, wherein guide and deflection rollers (3, 4) are provided which are arranged with clearance in the vicinity of a take-off platform (1) of the ski-jump and receive a cable (5), and wherein end portions (5*a*, 5*b*) of the cable are arranged along the landing piste (2) and are connectable to at least two snow grooming vehicles (6, 7) which are movable in opposite directions.

2. The device according to claim 1, wherein the end portions (5*a*, 5*b*) are equipped with float-type gliding bodies (8) which rest on the ground of the landing piste (2).

3. The device according to claim 2, wherein the rollers (3, 4) to receive and guide the cable (5) are arranged on the right and the left side of the take-off platform (1) of the ski-jump.

4. The device according to claim 3, wherein the float-type gliding bodies are arranged movably in relation to the end portions (5*a*, 5*b*) of the cable.

5. The device according to claim 4, wherein the float-type gliding bodies (8) are designed as hollow bodies which are freely penetrated by the cable (5).

6. The device according to claim 5, wherein the float-type gliding bodies (8) have a rounded shape and rounded edges so that the float-type gliding bodies (8) glide over the ground (2) of the landing piste.

7. The device according to claim 6, wherein entry and exit openings of the float-type gliding bodies (8) are fitted with running rollers (11, 12) which are arranged in parallel on both sides of the cable (5*a*, 5*b*).

8. The device according to claim 7, wherein the running rollers (11, 12) are received by L-shaped fixtures (13, 14) on the float-type gliding bodies, one arm of the L-shaped fixture serving as a means of attachment on each float-type gliding body (8) and the other arm of the L-shaped fixture serving as a lateral means of guidance of the cable end portions (5*a*, 5*b*).

9. The device according to claim 8, wherein the individual float-type gliding bodies (8) are connected to one another by an additional connecting means (15) serving as a spacer.

10. The device according to claim 9, wherein the snow grooming vehicles (6, 7) are connected to the end portions (5*a*, 5*b*) of the cable (5) in such a way that the front shield of each vehicle is always facing in a direction of travel (f, g) of the vehicle.

* * * * *